US011500308B2

(12) United States Patent
Yamana

(10) Patent No.: US 11,500,308 B2
(45) Date of Patent: Nov. 15, 2022

(54) IMAGE FORMING APPARATUS HAVING TRANSFER BELT AND CONDUCTIVE ROLLER DISPOSED IN MOVABLE UNIT

(71) Applicant: CANON KABUSHIKI KAISHA, Tokyo (JP)

(72) Inventor: Kentaro Yamana, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/329,952

(22) Filed: May 25, 2021

(65) Prior Publication Data

US 2021/0373464 A1 Dec. 2, 2021

(30) Foreign Application Priority Data

May 29, 2020 (JP) ..... JP2020-093798

(51) Int. Cl.
*G03G 15/16* (2006.01)

(52) U.S. Cl.
CPC ..... *G03G 15/1605* (2013.01)

(58) Field of Classification Search
CPC ..... G03G 15/1605; G03G 15/1665; G03G 15/167; G03G 21/16; G03G 21/1647; G03G 21/165; G03G 21/1695; G03G 21/168
See application file for complete search history.

(56) References Cited

U.S. PATENT DOCUMENTS 8,942,604 B2 * 1/2015 Ogiyama ..... G03G 15/1605 399/302
2008/0240767 A1 * 10/2008 Asahina ..... G03G 21/206 399/92
2011/0293312 A1 * 12/2011 Mimbu ..... G03G 15/1645 399/88
2012/0076513 A1 * 3/2012 Fujita ..... G03G 21/1638 271/265.02
2012/0328320 A1 * 12/2012 Fujita ..... G03G 15/1645 399/88
2014/0169828 A1 * 6/2014 Ohta ..... G03G 21/1695 399/110
2016/0238969 A1 * 8/2016 Kouzu ..... G03G 15/1675

FOREIGN PATENT DOCUMENTS

JP 2004-184875 A 7/2004
JP 2010-008670 A 1/2010
JP 2017-026872 A 2/2017

OTHER PUBLICATIONS

English translation of JP 20100008670.*

* cited by examiner

*Primary Examiner* — Arlene Heredia
(74) *Attorney, Agent, or Firm* — Venable LLP

(57) ABSTRACT

An image forming apparatus includes an image forming unit configured to form a toner image on an image bearing member, a first unit including an intermediate transfer belt on which the toner image is transferred from the image bearing member and a first roller disposed in contact with an inner surface of the intermediate transfer belt to stretch the intermediate transfer belt, the first unit being drawable from a main body of the image forming apparatus, a second unit including a second roller configured to form, with the first roller, a transfer nip portion in which the toner image is transferred from the intermediate transfer belt to a recording material, the second unit being drawable from the main body, and a high-voltage circuit board disposed in the second unit and configured to apply a voltage to the first roller.

11 Claims, 7 Drawing Sheets

IMAGE FORMING APPARATUS HAVING TRANSFER BELT AND CONDUCTIVE ROLLER DISPOSED IN MOVABLE UNIT

BACKGROUND OF THE INVENTION

Field of the Invention

This invention relates to an image forming apparatus which forms an image on a recording material.

Description of the Related Art

In an image forming apparatus of an intermediate transfer system, a toner image formed on a photosensitive member is transferred to an intermediate transfer belt, and thereafter transferred from the intermediate transfer belt to a recording material at a secondary transfer portion. The secondary transfer portion is a nip portion formed between a secondary transfer roller in contact with an outer surface of the intermediate transfer belt and a counter roller facing the secondary transfer roller across the intermediate transfer belt.

Incidentally, in a case where the secondary transfer is performed by applying a voltage with an opposite polarity of a normal charge polarity of the toner to the secondary transfer roller, a transfer performance may be deteriorated when a low resistance recording material such as a metallized paper is used. This is because a part of an electrical current fed to the secondary transfer roller leaks to the other conveyance rollers and the like along a non-transfer surface (back surface of a transfer surface onto which the toner image is transferred) of the recording material so that an effective electrical current contributing to formation of a transfer electric field electrostatically energizing the toner is decreased.

In this regard, Japanese Patent Laid-Open No. 2004-184875 describes a configuration in which the secondary transfer is performed by electrically connecting the secondary transfer roller to the ground potential and applying a voltage with the same polarity as the normal charge polarity of the toner to the counter roller. Since most of the electrical current fed to the counter roller reaches the transfer surface of the recording material in this configuration and contributes to the formation of the transfer electric field between the intermediate transfer belt and the recording material, a stable transfer performance is expected even in a case where the low resistance recording material is used.

A high-voltage circuit board, which applies the voltage to the counter roller disposed inside the intermediate transfer belt, is often disposed inside the intermediate transfer belt. However, in a case where capacity of the high-voltage circuit board is expanded along with a productivity improvement in the image forming apparatus, in a case where a cooling fan is required for a resistor attached to the high-voltage circuit board, and in a case of the like, it is sometimes difficult to secure a space to dispose the high-voltage circuit board inside the intermediate transfer belt.

SUMMARY OF THE INVENTION

The present invention provides an image forming apparatus that can achieve stable image transfer without securing a large space for a high-voltage circuit board inside the intermediate transfer belt.

According to one aspect of the invention, an image forming apparatus includes an image forming unit configured to form a toner image on an image bearing member, a first unit including an intermediate transfer belt on which the toner image is transferred from the image bearing member and a first roller disposed in contact with an inner surface of the intermediate transfer belt to stretch the intermediate transfer belt, the first unit being drawable from a main body of the image forming apparatus, a second unit including a second roller configured to form, with the first roller, a transfer nip portion in which the toner image is transferred from the intermediate transfer belt to a recording material, the second unit being drawable from the main body of the image forming apparatus, and a high-voltage circuit board disposed in the second unit and configured to apply a voltage to the first roller.

Further features of the present invention will become apparent from the following description of exemplary embodiments with reference to the attached drawings.

DESCRIPTION OF THE EMBODIMENTS

Hereinafter, embodiments of this disclosure will be described with reference to the attached drawings.

Figure 1:
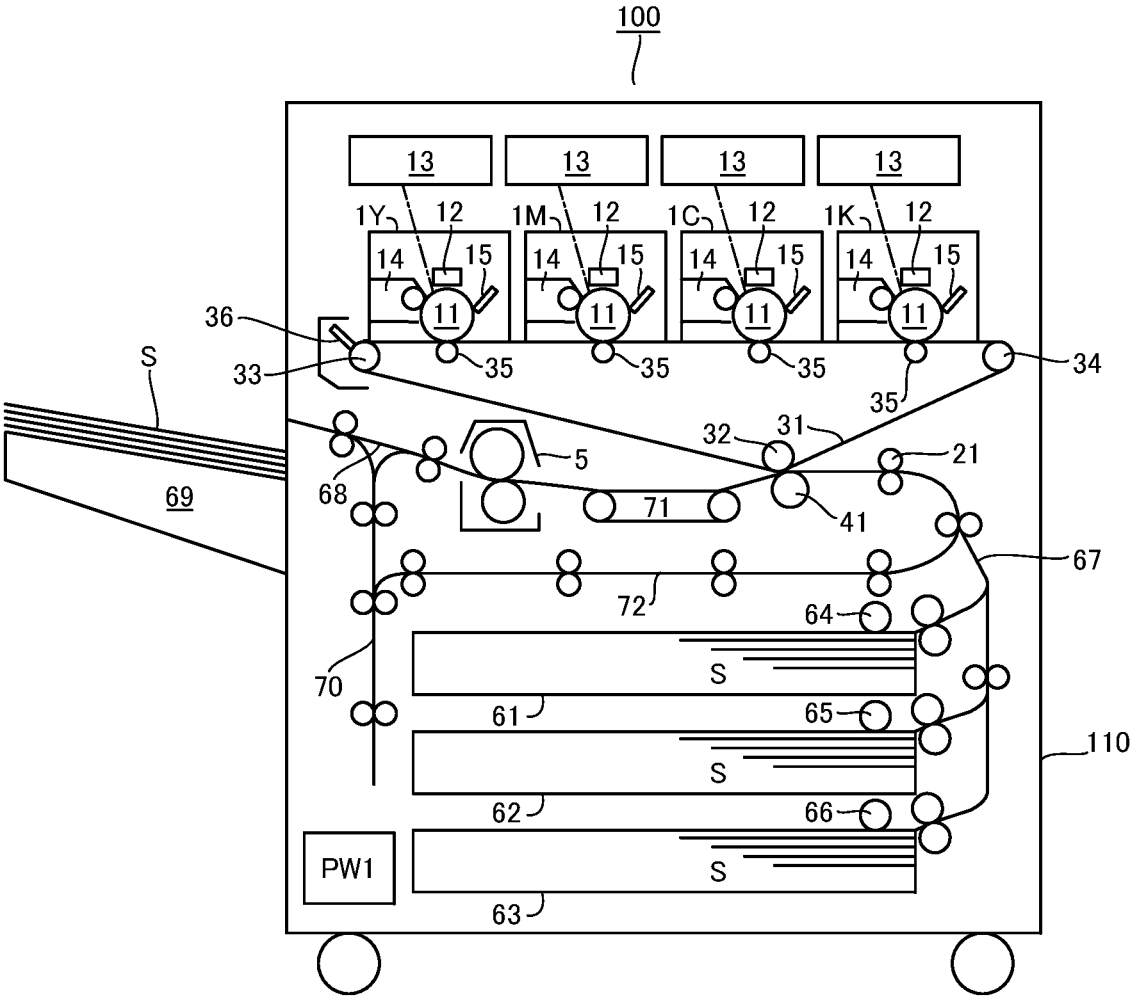
FIG. 1 is a schematic view of an image forming apparatus according to an embodiment of the present disclosure.

FIG. 1 is a schematic view showing a configuration of an image forming apparatus 100 according to one embodiment. This image forming apparatus 100 is an electrophotographic printer mounting an image forming engine of a tandem type intermediate transfer system, in which four image forming units 1Y, 1M, 1C, and 1K are disposed in series along a horizontal portion of an intermediate transfer belt 31, in an apparatus body 110 as a main body. The image forming apparatus 100 forms an image on a sheet material S in accordance with image information sent from, for example, an external apparatus. To be noted, for the sheet material S used as a recording material, it is possible to use various kinds of sheets different in sizes and materials including, but not limited to, a paper such as a standard paper and a cardboard, a plastic film, a cloth, various kinds of sheet materials applied with a surface treatment such as a coated paper, and a specially shaped sheet such as an envelope and an index paper. Further, the term "image forming apparatus" includes a copy machine, a multifunction machine, a commercial printing press, or the like other than a printer having only a printing function.

Each of the image forming units 1Y, 1M, 1C, and 1K includes a photosensitive drum 11 that serves as an image bearing member and that is a drum shaped electrophotographic photosensitive member, a charge unit 12, an exposing unit 13, a developing unit 14, and a drum cleaner 15. When the image information and an execution command of an image forming operation are input, the charge unit 12 uniformly charges a surface of the rotating photosensitive drum 11. The exposing unit 13 exposes the photosensitive drums 11 based on the image information, and forms an electrostatic latent image corresponding to a monochromic image of yellow, magenta, cyan, or black on the surface of the photosensitive drum 11. The developing unit 14 supplies toner charged with a predetermined normal charge polarity to the photosensitive drum 11, and develops the electrostatic latent image into toner images of each color of yellow, magenta, cyan, and black.

The intermediate transfer belt 31 is stretched over a drive roller 33, a tension roller 34, and a counter roller 32 (also called secondary transfer inner roller), and rotatably driven by the drive roller 33 in a clockwise direction in the figure. Inside the intermediate transfer belt 31, primary transfer rollers 35 each are disposed at a position facing one of the photosensitive drums 11 of the image forming units 1Y, 1M, 1C, and 1K across the intermediate transfer belt 31.

Toner image forming processes described above at the image forming units 1Y, 1M, 1C, and 1K are performed in parallel, and the toner images of each color are transferred to the intermediate transfer belt 31 by the primary transfer rollers 35 to which a bias voltage (primary transfer voltage) with an opposite polarity of the normal charge polarity of the toner is applied. At this time, a full color toner image is formed on the intermediate transfer belt 31 by superimposing the toner images of each color on one another. Adhesive matters, such as transfer residual toner remaining on the photosensitive drum 11 and not transferred to the intermediate transfer belt 31, are removed by the drum cleaner 15.

The full color toner image formed on the intermediate transfer belt 31 is conveyed to a secondary transfer portion by rotation of the intermediate transfer belt 31. The secondary transfer portion is a nip portion (i.e., transfer nip portion) formed between the counter roller 32 and a secondary transfer roller 41 facing the counter roller 32 across the intermediate transfer belt 31. The counter roller 32 serves as a first roller of the present embodiment capable of coming into contact with an inner surface of the intermediate transfer belt 31. The secondary transfer roller 41 serves as a second roller of the present embodiment capable of coming into contact with an outer surface of the intermediate transfer belt 31.

In parallel with operations of the image forming units 1Y to 1K and the intermediate transfer belt 31, the sheet material S is fed one by one from cassettes 61, 62, and 63 toward the secondary transfer portion. That is, the sheet material S stored in the cassettes 61, 62, and 63 is sent into a conveyance path 67 by rotation of one of feed rollers 64, 65, and 66 corresponding to the cassettes 61, 62, and 63. When the sheet material S reaches a registration roller 21 via the conveyance path 67, the registration roller 21 sends out the sheet material S to the secondary transfer portion synchronizing with a timing in which the toner image borne on the intermediate transfer belt 31 reaches the secondary transfer portion.

Since a bias electric field (transfer electric field) is being formed between the intermediate transfer belt 31 and the sheet material S by a secondary transfer voltage, described later, at the secondary transfer portion, the toner image is transferred from the intermediate transfer belt 31 to the sheet material S at the secondary transfer portion. Adhesive matters, such as transfer residual toner remaining on the intermediate transfer belt 31 and not transferred to the sheet material S, are removed by a belt cleaner 36.

The sheet material S having passed through the secondary transfer portion is conveyed to a fixing unit 5 via a conveyor belt 71. The fixing unit 5 of this embodiment is of a heat fixation type, and includes a rotary member pair constituted by a roller or a belt, and a heating unit such as a halogen lamp or a ceramic heater. By providing the toner image on the sheet material S with heat and pressure while conveying the sheet material S by nipping with the rotary member pair, the fixing unit 5 performs a fixing process of fixing the toner image on the sheet material S. The sheet material S having passed through the fixing unit 5 is discharged to a sheet discharge tray 69 disposed outside the image forming apparatus 100 via a sheet discharge path 68. In a case where the image is formed on both surfaces of the sheet material S, the sheet material S with the image formed on a first surface is conveyed again toward the registration roller 21 via a reverse conveyance path 70 and a duplex conveyance path 72. Then, while the sheet material S passes through the secondary transfer portion and the fixing unit 5, the image is formed on a second surface, and thereafter the sheet material S is discharged to the sheet discharge tray 69.

Figure 2:
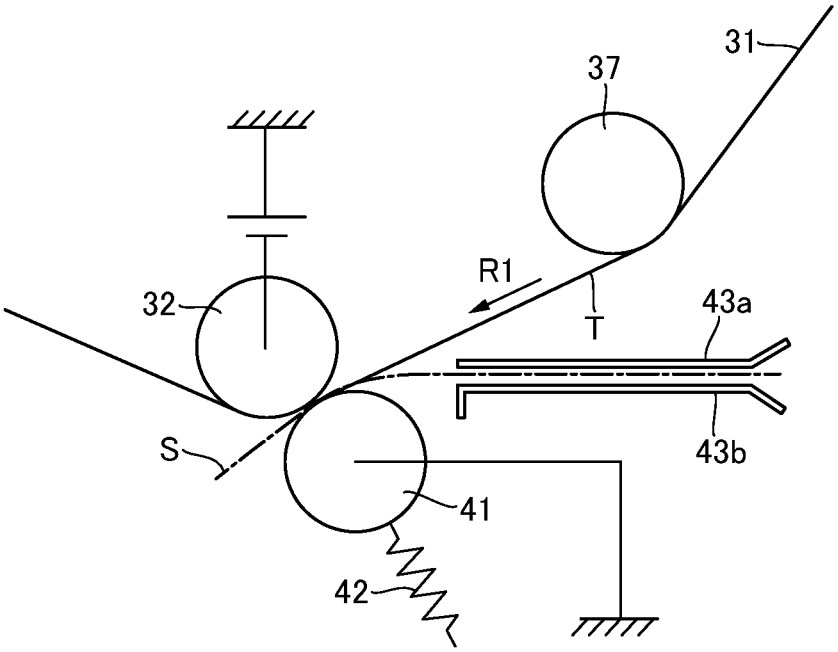
FIG. 2 is a schematic view of a secondary transfer portion and surroundings thereof in the image forming apparatus according to the embodiment.

Using FIG. 2, the secondary transfer portion of the image forming apparatus 100 will be described. In the present embodiment, a guide roller 37 arranged in contact with the inner surface of the intermediate transfer belt 31 is disposed upstream of the counter roller 32 in a rotational direction R1 of the intermediate transfer belt 31. Therefore, the intermediate transfer belt 31 moves toward the secondary transfer portion along a stretching line T which is an external common tangent of the guide roller 37 and the counter roller 32.

Further, the secondary transfer roller 41 is urged by a secondary transfer roller spring 42, serving as an urging member, in an approaching direction to the counter roller 32. Therefore, the secondary transfer portion is formed as the nip portion between the secondary transfer roller 41 and the counter roller 32 coming into contact with each other across the intermediate transfer belt 31 with a predetermined pressure force.

At this point, a voltage (i.e., secondary transfer voltage) with the same polarity as the normal charge polarity of the toner (assuming negative polarity here), with which the image forming units 1Y to 1K form the toner image, is applied to the counter roller 32. On the other hand, the secondary transfer roller 41 is electrically connected to a ground potential via, for example, a metallic frame member of the image forming apparatus 100. Therefore, the transfer electric field electrostatically energizing a charged toner particle to the secondary transfer roller 41 is formed in the secondary transfer portion. When the sheet material S sent out from the registration roller 21 reaches the secondary transfer portion by being guided by pre-transfer guides 43*a* and 43*b*, the toner particle is transferred from the intermediate transfer belt 31 to the sheet material S in accordance with the transfer electric field described above so that the toner image is transferred.

As described above, by applying the voltage with the same polarity as the toner to the counter roller 32 inside the intermediate transfer belt 31, an electrical current fed to the counter roller 32 reaches a transfer surface of the sheet material S while forming the transfer electric field between the intermediate transfer belt 31 and the sheet material S. A part of the electrical current that has reached the transfer surface of the sheet material S flows from the transfer surface to a non-transfer surface of the sheet material S, and flows to the grounded secondary transfer roller 41. Another part of the electrical current that has reached the transfer surface of the sheet material S flows to members (for example, the pre-transfer guide 43*a*) other than the secondary transfer roller 41 along the transfer surface of the sheet material S.

Since an amount of the electrical current not flowing to the secondary transfer roller 41 and leaking along the transfer surface of the sheet material S depends on a resistance (especially, surface resistance) of the sheet material S, a leakage current increases in a case of a low resistance sheet material S such as a metallized paper. However, since, regardless of the amount of the leakage current, the electrical current fed to the counter roller 32 at least reaches the transfer surface of the sheet material S while forming the transfer electric field, a stable transfer electric field is formed, and contributes to improved stability of a transfer performance.

The image forming apparatus 100 of the present embodiment is an apparatus capable of attaining high productivity, and the intermediate transfer belt 31 conveys the sheet material S at a speed (as a peripheral speed) of 400 mm/s (millimeters/second), and the toner is charged with a negative polarity. So as to ensure the high transfer performance even at this speed, a voltage of, for example, −10 kV (kilo-volt) is applied to the counter roller 32. However, the speed of the intermediate transfer belt 31 (i.e., process speed of the image forming operation), the normal charge polarity of the toner, and a voltage value of the secondary transfer voltage are not limited to those mentioned above.

A high-voltage circuit board generating a high voltage is required so as to apply the secondary transfer voltage to the counter roller 32. The high-voltage circuit board means a board which includes a circuit generating a higher voltage than a voltage of a commercial power source (i.e., voltage supplied from an outside to the image forming apparatus 100) connected to the image forming apparatus 100. Since the counter roller 32 is disposed inside the intermediate transfer belt 31, it is also considered to dispose the high-voltage circuit board for the second transfer voltage also in a space inside the intermediate transfer belt 31. However, after examination, it was found to be difficult to dispose the high-voltage circuit board inside the intermediate transfer belt 31 since the high-voltage circuit board having a large capacity of −10 kV is relatively large in a size. For example, since it is necessary to enlarge a circumference of the intermediate transfer belt 31 and change a stretch path of the intermediate transfer belt 31 so as to dispose the high-voltage circuit board inside the intermediate transfer belt 31, the image forming apparatus 100 may become enlarged.

Further, since an amount of heat generation by the large capacity high-voltage circuit board becomes also large, an attention is paid to a cooling performance of the high-voltage circuit board. For example, it is considered to secure a space to flow cooling air around the high-voltage circuit board or dispose a fan to cool a resistor which becomes a main heat source. These configurations also lead to an enlargement of the image forming apparatus 100.

Accordingly, as described later in each embodiment, a configuration to dispose the high-voltage circuit board in a space outside the intermediate transfer belt 31 is applied in the present embodiment. To be noted, the space inside the intermediate transfer belt 31 means a space which is surrounded by the intermediate transfer belt 31 when viewed in a main scanning direction at the image forming operation (axis directions of the counter roller 32 and the secondary transfer roller 41) and inside the maximum width of the intermediate transfer belt 31 with respect to the main scanning direction. Further, a space outside the intermediate transfer belt 31 indicates a space which excludes the space inside the intermediate transfer belt 31 in the image forming apparatus 100.

Attachment and Detachment Configuration of Conveyance Unit

Figure 3A:
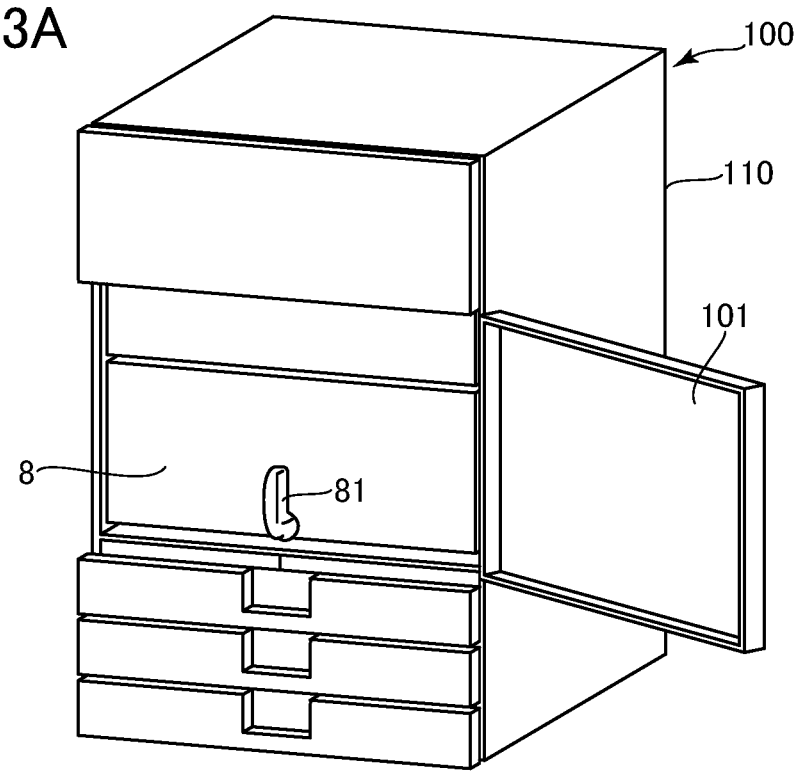
FIGS. 3A and 3B are diagrams for a description of an attachment and detachment of a conveyance unit according to the embodiment.
Figure 3B:
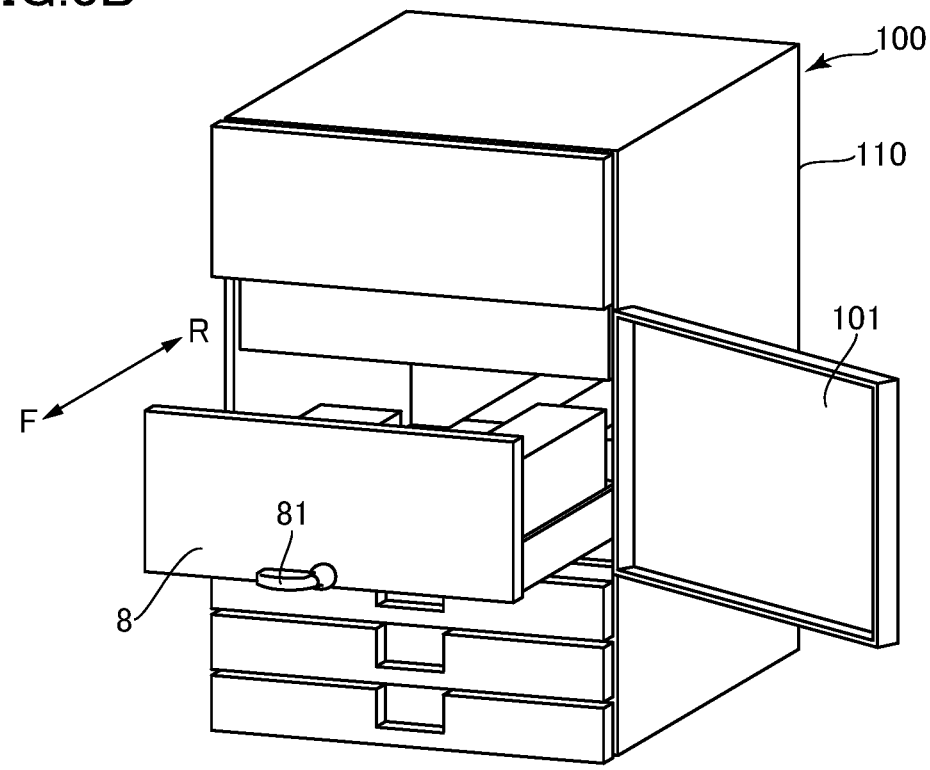

Using FIGS. 3A and 3B, an attachment and detachment configuration of a conveyance unit according to the present embodiment will be described. Regarding the image forming apparatus 100, it is necessary to access a conveyance path of the sheet material S in a case where the sheet material S is jammed in the apparatus, in a case where a periodical maintenance is performed, and in a case of the like. The image forming apparatus 100 of the present embodiment, as shown in FIGS. 3A and 3B, includes a conveyance unit 8, serving as a drawer unit capable of being drawn out from and inserted into the apparatus body 110 as a casing, and the conveyance path is accessible by drawing out the conveyance unit 8. Hereinafter, a direction in which the conveyance unit 8 is drawing out from the apparatus body 110 is referred to as a front (or front face side) of the image forming apparatus 100, and the opposite side is referred to as a rear (or back face side) of the image forming apparatus 100.

In a usage state where the image forming apparatus 100 is capable of performing the image forming operation, the conveyance unit 8 is attached to a predetermined attachment position inside the apparatus body 110, and a lock handle 81 is at a predetermined lock position (refer to FIG. 3A) so that the conveyance unit 8 is in an attached state in which drawing out of the conveyance unit 8 is restricted. Further, a front door 101 is also closed in the usage state.

By opening the front door 101, access to the lock handle 81 is enabled. The conveyance unit 8 is unlocked by turning the lock handle 81 by 90 degrees so that it is possible to draw out the conveyance unit 8 as shown in FIG. 3B. Herewith, at least a part of conveyance and guide members, such as the secondary transfer roller 41, constituting the conveyance path in which the sheet material S is conveyed in the image forming apparatus 100 is exposed outside the apparatus body 110. That is, a user or a maintenance person is able to perform a job by accessing the conveyance path of the sheet material S by bringing the conveyance unit 8 into a drawn-out state shown in FIG. 3B.

To be noted, in a case of returning the conveyance unit 8 to the attached state, the conveyance unit 8 is pushed in from the state of FIG. 3B to the attachment position in a direction toward the rear of the apparatus body 110, and thereafter the lock handle 81 is locked by turning it by 90 degrees in the opposite direction.

First Example

Figure 4A:
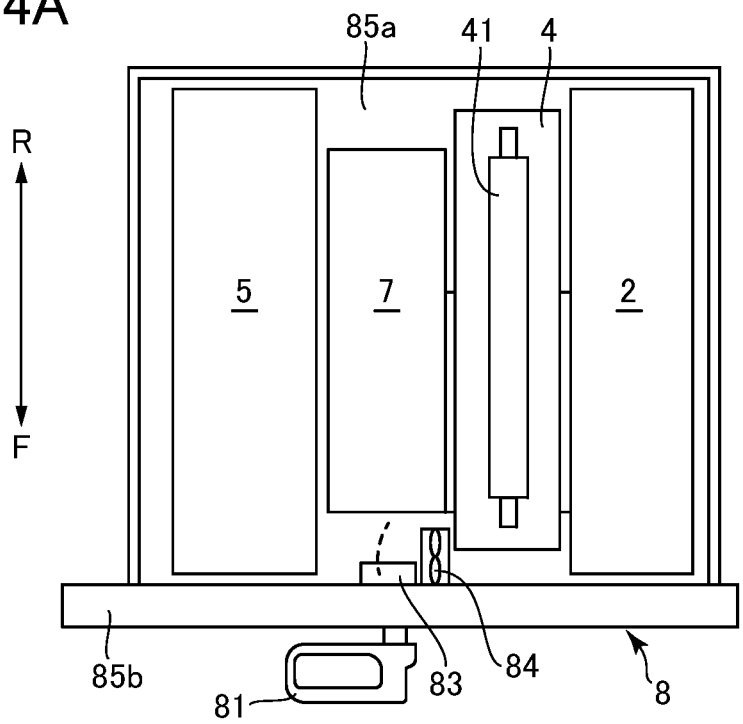
FIGS. 4A and 4B are schematic views showing an internal configuration of the conveyance unit according to a first example.

A power feed configuration of the secondary transfer voltage as a first practical embodiment (i.e., a first example) of the present example will be described. FIG. 4A is a schematic view of the conveyance unit 8 of this example when viewed from above, and FIG. 4B is a diagram in which a secondary transfer unit 4 and a pre-fixing conveyance unit 7 in FIG. 4A are shown in phantom.

As shown in FIG. 4A, in the conveyance unit 8, a registration unit 2 including the registration roller 21, the secondary transfer unit 4 including the secondary transfer roller 41, the pre-fixing conveyance unit 7 including the conveyor belt 71, and the fixing unit 5 are disposed. These elements are fitted to a bottom plate 85*a* constituting a bottom portion of a frame member of the conveyance unit 8. Further, the conveyance unit 8 is drawn out to one side (arrow F direction) in the main scanning direction at the image formation, and inserted into the other side (arrow R direction) in the main scanning direction.

Figure 4B:
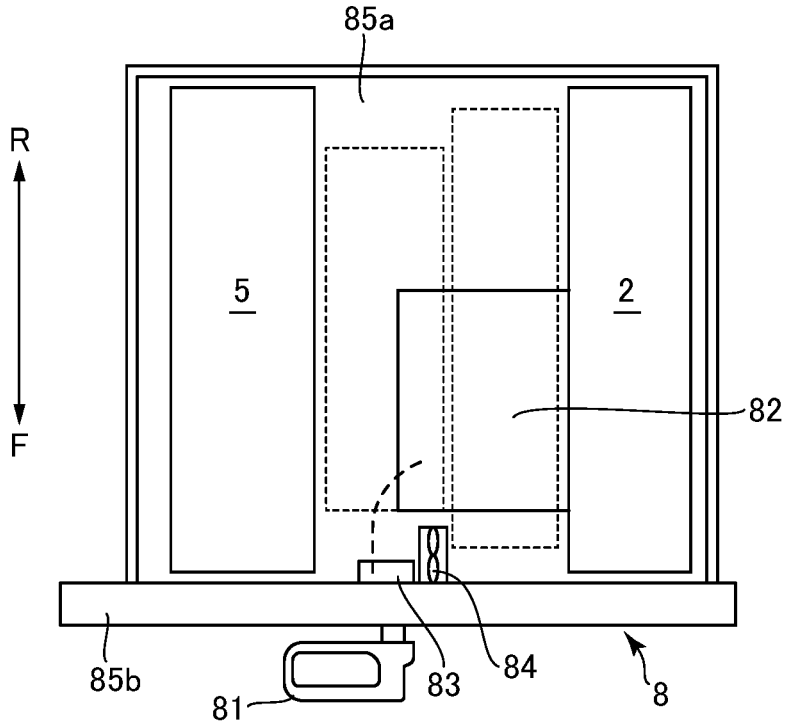

Further, as shown in FIG. 4B, a high-voltage circuit board 82 generating the secondary transfer voltage so as to apply to the counter roller 32 is fitted to the bottom plate 85*a*. The high-voltage circuit board 82 is disposed below the secondary transfer unit 4 and the pre-fixing conveyance unit 7, and accessible by removing (detaching) the secondary transfer unit 4 and the pre-fixing conveyance unit 7 with the conveyance unit 8 taken out. When viewed in the gravity direction, the high-voltage circuit board 82 is disposed at a position overlapping with the secondary transfer unit 4 and the pre-fixing conveyance unit 7. Further, the high-voltage circuit board 82 is disposed on the front of the apparatus (in arrow F direction) in the main scanning direction at the image formation. Herewith, it is possible to improve ease of assembly at integrating the high-voltage circuit board 82 into the apparatus.

Since the high-voltage circuit board 82 outputs a high bias voltage of −10 kV in this example, if the resistor is disposed on the high-voltage circuit board 82, the other circuit elements on the high-voltage circuit board 82 may be damaged by heat generated by the resistor. Therefore, a resistor 83 disposed at a separate position from the high-voltage circuit board 82 is fitted to a front-side side plate 85*b* of the conveyance unit 8, and is electrically connected to the high-voltage circuit board 82 by a bundle wire, as shown by the dashed line in FIG. 4B. Further, so as to protect the resistor 83 from damage by its own heat generation, a fan 84 for cooling the resistor 83 is disposed on the front-side side plate 85*b*.

A power source PW1 (FIG. 1) configured to feed electric power to the high-voltage circuit board 82 is disposed in the apparatus body, and is configured to be electrically connected to the high-voltage circuit board 82 disposed in the conveyance unit 8 via a drawer connector in a case where the conveyance unit 8 is in the attached state. Since, when the conveyance unit 8 is drawn out from the apparatus body, the drawer connector is separated and an electrical connection between the high-voltage circuit board 82 and the power source PW1 is cut off, it is possible to more certainly stop an electric power feed to the high-voltage circuit board 82.

To be noted, a combination of elements disposed in the conveyance unit 8 is not limited to the illustrated combination, and, for example, it is acceptable to fit the fixing unit 5 to the apparatus body. In this case, it is acceptable to configure the image forming apparatus 100 with two apparatus body frame members so that a unit performing processes until a secondary transfer process of the sheet material S in the image forming operation is disposed in a first apparatus body frame member and a unit to perform processes subsequent to the secondary transfer process is disposed in a second apparatus body frame member. Further, it is acceptable to dispose the high-voltage circuit board 82 together with the secondary transfer unit 4 and the registration unit 2 in a conveyance unit capable of being drawn out from the first apparatus body frame member.

As described above, in this example, the high-voltage circuit board 82 is disposed in the conveyance unit 8 which is capable of being drawn out from the apparatus body. On the other hand, the counter roller 32 to which the high-voltage circuit board 82 applies the secondary transfer voltage is disposed in the apparatus body. Therefore, this example applies a configuration in which, when the conveyance unit 8 changes a state from the drawn-out state to the attached state, the secondary transfer unit 4 is positioned adjacent to an intermediate transfer belt unit 6 including the intermediate transfer belt 31 and at the same time the high-voltage circuit board 82 and the counter roller 32 are electrically connected to each other. The intermediate transfer belt unit 6 is a first unit of this example, and the conveyance unit 8 is a second unit of this example, and both the units are capable of being drawn out, i.e., drawable, from the apparatus body.

Figure 5A:
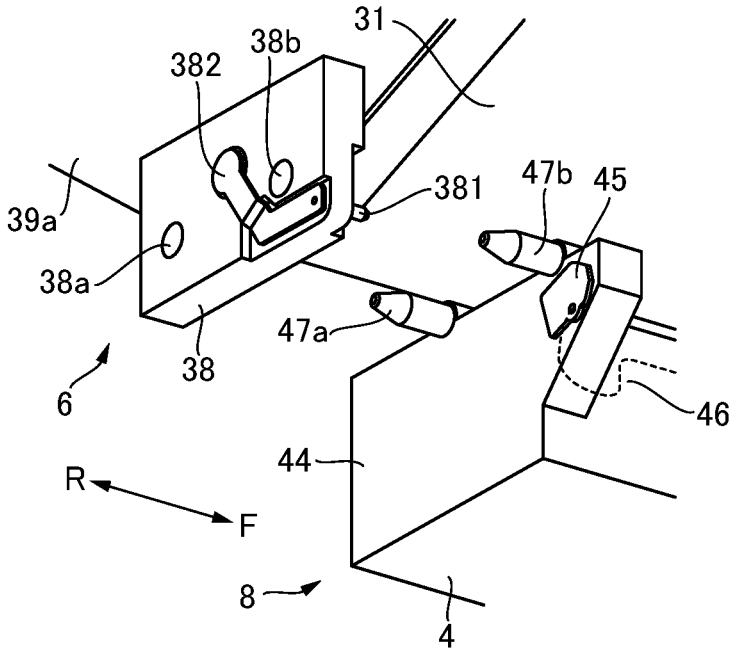
FIGS. 5A and 5B are schematic views showing a connecting configuration of a secondary transfer unit and an intermediate transfer belt according to the first example.

Connecting Configuration of Secondary Transfer Unit and Intermediate Transfer Belt Unit At first, using FIGS. 5A and 5B, a connecting configuration of the secondary transfer unit 4 and the intermediate transfer belt unit 6 will be described. FIG. 5A shows a state where the conveyance unit 8 is drawn out from the attachment position in the apparatus body (i.e., a state where positioning of the secondary transfer unit 4 is released).

The secondary transfer unit 4 includes positioning pins 47*a*, 47*b*, and a first contact plate 45, serving as a conduction member, and these positioning pins 47*a*, 47*b*, and first contact plate 45 are fitted to a secondary transfer frame 44, serving as a frame member of the secondary transfer unit 4. The first contact plate 45 serves as a second electrical contact portion disposed in the second unit and electrically connected to the high-voltage circuit board. A first high voltage bundle wire 46 electrically connected to the high-voltage circuit board 82 is connected to the first contact plate 45, and supported by the secondary transfer frame 44.

Figure 5B:
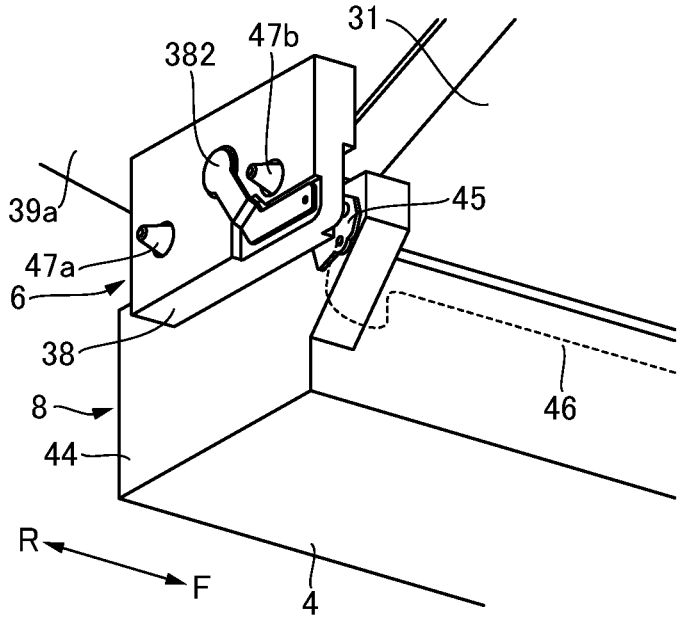

As shown in FIGS. 5A and 5B, a secondary transfer unit holding member 38 is fitted to an intermediate transfer frame 39*a* disposed in a manner capable of being drawn out from the apparatus body. The intermediate transfer frame 39*a* is a frame (i.e., frame member of the intermediate transfer belt unit 6) rotatably supporting a plurality of stretching rollers stretching the intermediate transfer belt 31. The plurality of stretching rollers includes the drive roller 33, the tension roller 34, and the counter roller 32 in FIG. 1. A second contact plate 382, which serves as a first electrical contact portion attached to the positioning member and electrically connected to the first roller, is fitted to the secondary transfer unit holding member 38. Further, a first contact pin 381 is held by the secondary transfer unit holding member 38 movably in an axial direction. A first pushing spring (not shown) is disposed between the second contact plate 382 and the first contact pin 381, and the second contact plate 382 and the first contact pin 381 are electrically connected to each other via the first pushing spring. To be noted, the intermediate transfer belt unit 6 is capable of being drawn out and attached, together with the conveyance unit 8, in approximately the same direction as a drawing out direction (arrow F direction) and attaching direction (arrow R direction) of the conveyance unit 8.

FIG. 5A shows a separation state where the conveyance unit 8 is drawn out from the attachment position in the apparatus body, and FIG. 5B shows the attached state where the conveyance unit 8 is attached to the apparatus body. Both are the figures showing aspects around the secondary transfer unit holding member 38 when viewed from below and from the rear side in the attaching direction (arrow R direction) of the conveyance unit 8 to the apparatus body.

In the attached state, two positioning pins 47*a* and 47*b* of the secondary transfer unit 4 are respectively inserted into a hole 38*a* and a rotation stopper hole 38*b* disposed in the secondary transfer unit holding member 38 serving as a positioning member in the present example. Herewith, the secondary transfer unit 4 is positioned adjacent to the intermediate transfer belt unit 6 with respect to a direction intersecting with the attaching and detaching directions (arrow F and R directions) of the conveyance unit 8. Further, the first contact pin 381 being pushed by the pushing spring in the arrow F direction comes into contact with the first contact plate 45 (refer to FIG. 5B) so that the high-voltage circuit board 82 for the secondary transfer and the second contact plate 382 are electrically connected to each other. That is, electrical contact members of this example, which electrically connect and disconnect the high-voltage circuit board 82 and the counter roller 32 depending on the attachment and detachment of the conveyance unit 8, are constituted by the first contact pin 381, serving as a first contact member, and the first contact plate 45, serving as a second contact member.

Support and Power Feeding Configurations of Counter Roller

Figure 6:
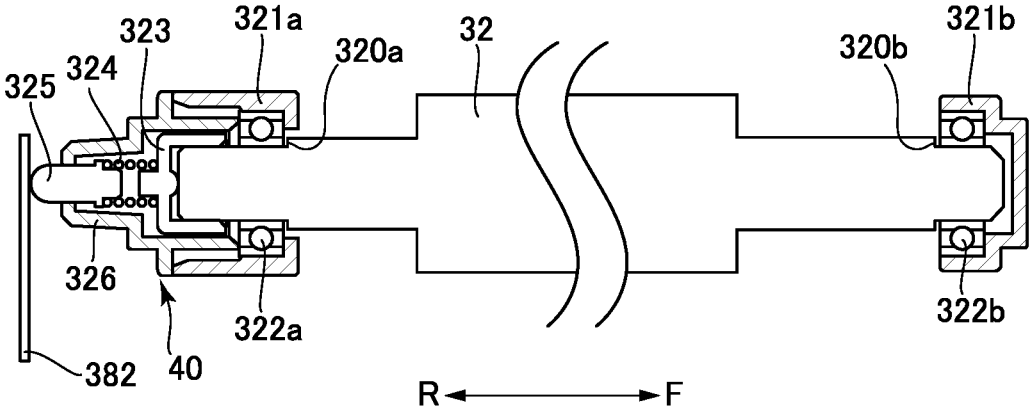
FIG. 6 is a schematic view showing a support configuration and a power feed configuration of a counter roller according to the first example.

Using FIG. 6, a support configuration of the counter roller 32 and a power feeding configuration of the secondary transfer voltage inside the intermediate transfer belt unit 6 will be described. Both ends of a shaft portion of the counter roller 32 in an axial direction are rotatably supported by two bearings 322*a* and 322*b*. Two bearings 322*a* and 322*b* respectively come into contact with bumps 320*a* and 320*b* disposed on the shaft portion of the counter roller 32 so that movements of the bearings 322*a* and 322*b* inside the counter roller 32 in the axial direction are restricted. To be noted, the bearings 322*a* and 322*b* are not limited to a ball bearing as illustrated in the figure, and it is acceptable to use, for example, a cylindrical roller bearing or a slide bearing.

Further, the bearings 322*a* and 322*b* are respectively supported by counter roller holding members 321*a* and 321*b*, serving as holding members. The counter roller holding members 321*a* and 321*b* are disposed in such a manner as a part of the frame member of the apparatus body, or fixed to a frame member. Further, the counter roller holding member 321*b* on one side in the axial direction (arrow F direction, opposite to the second contact plate 382) is fixed to, for example, the frame member of the intermediate transfer belt unit 6. Herewith, movements to the one side in the axial direction of the counter roller 32, the bearings 322*a* and 322*b*, and the counter roller holding member 321*a* on the other side are restricted.

A power feed unit 40 is disposed on the other side of the counter roller 32 in the axial direction (arrow R direction). The power feed unit 40 is constituted by a power feed member 323 as a conduction member, a second pushing spring 324, a second contact pin 325, and a power feed cover 326. All of the power feed member 323, the second pushing spring 324, and the second contact pin 325 are formed of conductive material, and disposed inside the power feed cover 326.

The power feed member 323 comes into contact with the shaft portion of the counter roller 32. The second contact pin 325 is supported by the power feed cover 326 slidably in the axial direction of the counter roller 32, and capable of projecting in the axial direction from an opening portion of the power feed cover 326. The second pushing spring 324 is disposed between the power feed member 323 and the second contact pin 325 in the axial direction, and urges the power feed member 323 toward the one side in the axial direction and the second contact pin 325 toward the other side in the axial direction.

The power feed cover 326 is fitted to the counter roller holding member 321*a*. At this point, a part of the power feed cover 326 fitted to the counter roller holding member 321*a* comes into contact with a surface of the bearing 322*a* opposite to the bump 320*a*, with whose surface the bearing 322*a* comes into contact, in the axial direction. Therefore, a movement of the bearing 322*a* outside the counter roller 32 in the axial direction (arrow R direction) is restricted.

Inside the power feed unit 40, by a resilient force of the second pushing spring 324, the power feed member 323 is pressed to a first end of the counter roller 32 in the axial direction, and also the second contact pin 325 is pressed to the second contact plate 382. Herewith, the second contact plate 382 and the counter roller 32 are electrically connected to each other via the second contact pin 325, the second pushing spring 324, and the power feed member 323.

As described above, in a state where the conveyance unit 8 is attached to the predetermined attachment position inside the apparatus body, the high-voltage circuit board 82 and the second contact plate 382 are electrically connected to each other. That is, when the conveyance unit 8 is in the attached state, the counter roller 32 is electrically connected to the high-voltage circuit board 82 for the secondary transfer voltage.

In this example, the power feed cover 326 is an insulator applying PC+ABS resin (alloy of polycarbonate and acrylonitrile butadiene styrene resin) as an insulating material. This is to prevent a leakage of a high voltage electrical current, which flows in the power feed member 323, the second pushing spring 324, and the second contact pin 325 in a case where the intermediate transfer frame 39*a* is constituted by an electrically conductive material, such as a metal plate, electrically connected to the ground potential.

By forming a layer of a predetermined resistance value electrically conductive rubber on a surface of the counter roller 32, it is possible to achieve stabilization of the secondary transfer electrical current and prevention of a slippage of the counter roller 32 with respect to a back surface of the intermediate transfer belt 31. However, since wear of the rubber layer and adhesion of stains of such as the toner and an external additive for the toner in a long-term use make it difficult to secure a stable supply of the secondary transfer electrical current, in some cases it is necessary to replace the counter roller 32.

Since, in this example, the second pushing spring 324 built in the power feed unit 40 provides a power feed contact pressure, the pressure from the second pushing spring 324 is released when the power feed unit 40 is separated from the counter roller 32. Therefore, in comparison with a case where a plate spring, which comes into pressure contact with the shaft portion of the counter roller 32 from an outside in a radial direction, is used both as the power feed member and as an urging member, it is possible to reduce possibilities of an occurrence of plastic deformation of the power feed member, the urging member, and the like at a time of replacement of the counter roller 32.

Specific replacement procedures of the counter roller 32 are: at first, detach the secondary transfer unit holding member 38 supporting the second contact plate 382 from the intermediate transfer frame 39*a*, and thereafter detach the intermediate transfer belt 31. Then, detach the power feed cover 326, which is fixed to the counter roller holding member 321*a* by connectors such as screws, from the counter roller holding member 321*a*. Herewith the counter roller 32 becomes movable in the axial direction (arrow R direction) together with the bearings 322*a* and 322*b*, so that it is possible to detach the counter roller 32 from the counter roller holding members 321*a* and 321*b*.

When attaching the new counter roller 32, bring the counter roller holding members 321*a* and 321*b* to hold the counter roller 32 by reversing the above procedures and inserting the counter roller 32 into the other side in the axial direction (arrow F direction) together with the bearing 322*a*. Then, complete the attachment of the counter roller 32 by fixing the power feed cover 326 to the counter roller holding member 321*a*.

Alternative Examples

The attachment and detachment configurations described above by using FIG. 6 are applicable to roller members disposed inside the intermediate transfer belt 31 and involved in the transfer of the toner image in the image forming apparatus other than the counter roller 32 (secondary transfer inner roller). For example, the primary transfer roller 35 (refer to FIG. 1) transferring the toner image from the photosensitive member to the intermediate transfer belt 31 by being applied with a primary transfer voltage is cited as one of such roller members.

Further, in a configuration in which a voltage with an opposite of the normal charge polarity of the toner is applied to the secondary transfer roller 41, it is acceptable to apply the attachment and detachment configurations described in the first example by disposing the power feed unit 40 in the secondary transfer roller 41. Further, in a direct transfer system in which the toner image is transferred from the photosensitive member to the recording material without using the intermediate transfer member, it is acceptable to apply the attachment and detachment configurations described in the first example to a transfer roller coming into contact with the photosensitive member.

Second Example

Although, in the first example, the configuration in which the high-voltage circuit board 82 and the counter roller 32 are electrically connected to each other via the secondary transfer unit 4 is described, it is also possible to more directly connect the high-voltage circuit board 82 of the conveyance unit 8 and the counter roller 32 of the apparatus body to each other. Hereinafter, a second example which is different from the first example in the connecting configuration of the high-voltage circuit board 82 and the counter roller 32 will be described. In the following descriptions, the elements assigned the same reference characters as the first example have substantially the same configurations and functions as the first example, and differences from the first example will be mainly described.

Figure 7A:
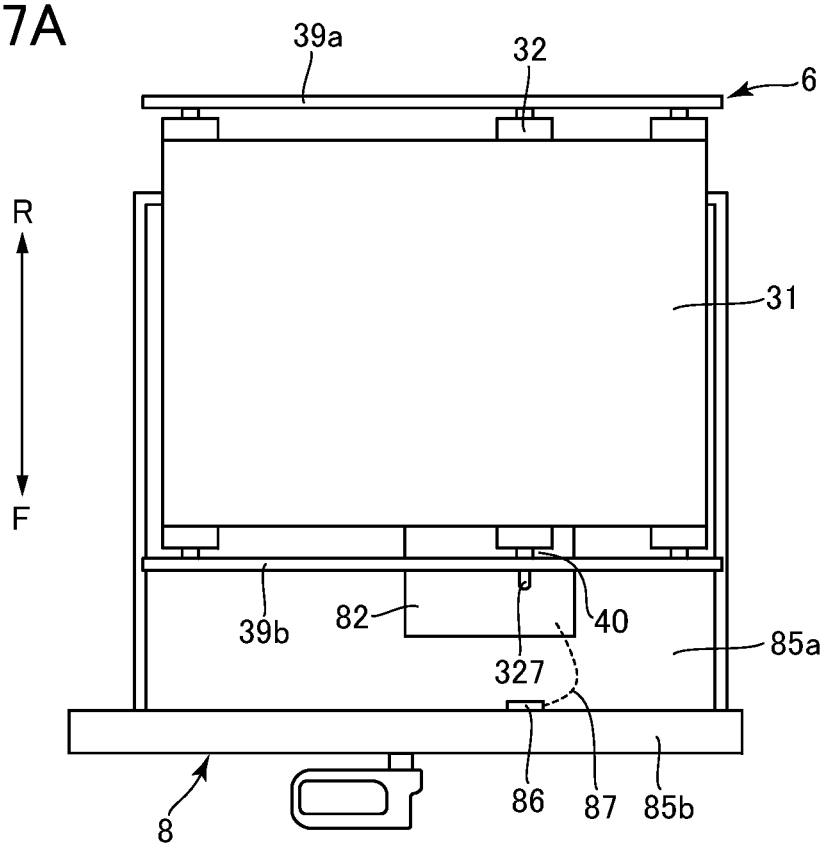
FIGS. 7A and 7B are schematic views for a description of an image forming apparatus according to a second example.
Figure 7B:
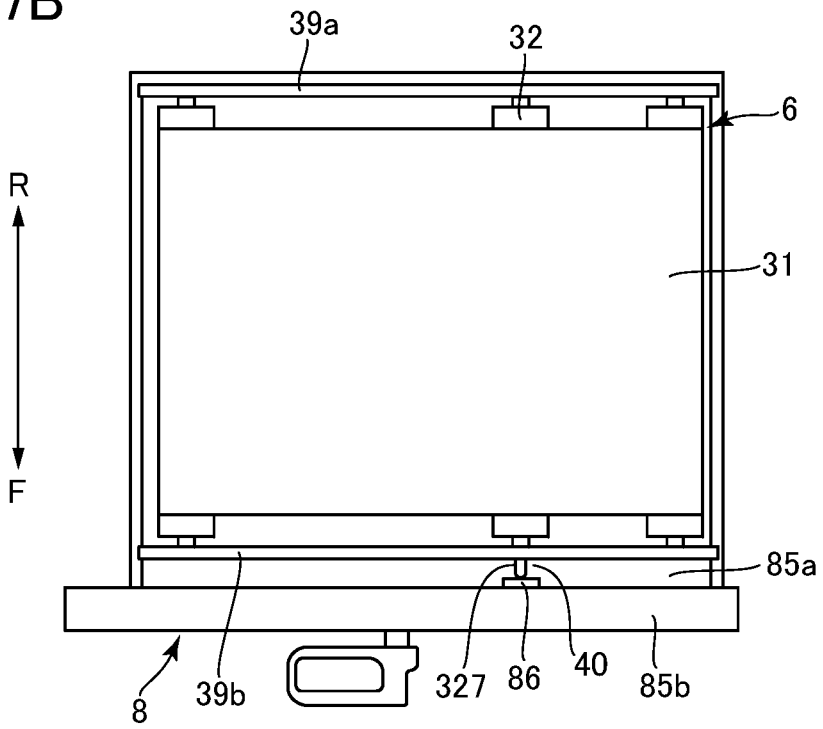

FIG. 7A shows an aspect, when viewed from above, of the intermediate transfer belt unit 6 and the conveyance unit 8 in a state where the conveyance unit 8 is drawn out. FIG. 7B shows the aspect, when viewed from above, of the intermediate transfer belt unit 6 and the conveyance unit 8 with the conveyance unit 8 inserted in the attachment position.

The intermediate transfer belt 31 is, as described above, stretched over the plurality of stretching rollers, including the counter roller 32, and each roller is supported by the intermediate transfer frames 39*a* and 39*b* disposed in the apparatus body. The power feed unit 40 similar to the first example is fitted to the counter roller 32, and a third contact pin 327 corresponding to the second contact pin 325 (refer to FIG. 6) of the first example projects from the intermediate transfer frame 39*b* (refer to FIG. 7A). Differently from the first example, the power feed unit 40 is disposed upstream of the conveyance unit 8 in the attaching direction (arrow F direction), and the third contact pin 327 is projecting in the arrow F direction. Further, the third contact pin 327 is slidable along the attaching direction of the conveyance unit 8, and urged in the arrow F direction by a third pushing spring corresponding to the second pushing spring 324 (refer to FIG. 6) of the first example.

On the other hand, in the conveyance unit 8, the high-voltage circuit board 82 disposed on the bottom plate 85*a* and a third contact plate 86 disposed on the front-side side plate 85*b* are connected to each other by a second high voltage bundle wire 87. The third contact plate 86 is disposed at a position facing the third contact pin 327 in the attaching direction of the conveyance unit 8.

The intermediate transfer frame 39*a* is positioned with respect to the frame member of the apparatus body as described above, and the conveyance unit 8 which is in the drawn-out state (refer to FIG. 7A) is brought into the attached state (refer to FIG. 7B) by being inserted in the arrow R direction. At this time, the third contact plate 86 comes into contact with the third contact pin 327 which is urged by the third pushing spring, so that the high-voltage circuit board 82 and the counter roller 32 are electrically connected to each other via the second high voltage bundle wire 87, the third contact plate 86, and the power feed unit 40. That is, an electrical contact portion of this example, which electrically connects and disconnects the high-voltage circuit board 82 and the counter roller 32 to and from each other depending on the attachment and detachment of the conveyance unit 8, is formed by the third contact pin 327, serving as a third contact member, and the third contact plate 86, serving as a fourth contact member.

OTHER EMBODIMENTS

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-093798, filed on May 29, 2020, which is hereby incorporated by reference herein in its entirety.

What is claimed is:

1. An image forming apparatus comprising:

an apparatus body having an image forming unit configured to form a toner image on an image bearing member;

a first unit including an intermediate transfer belt on which the toner image is transferred from the image bearing member and a first roller disposed in contact with an inner surface of the intermediate transfer belt to stretch the intermediate transfer belt;

a second unit having a secondary transfer unit that includes a second roller configured to form, with the first roller, a transfer nip portion in which the toner image is transferred from the intermediate transfer belt to a recording material, the second unit being drawable from the apparatus body; and a high-voltage circuit board disposed in the second unit and configured to apply a voltage to the first roller in the first unit without passing through the second roller in the second unit.

2. The image forming apparatus according to claim 1, wherein the high-voltage circuit board is disposed below the secondary transfer unit and at a position overlapping with the secondary transfer unit when viewed in a gravity direction.

3. The image forming apparatus according to claim 1, further comprising:

a first electrical contact portion disposed in the first unit and electrically connected to the first roller; and a second electrical contact portion disposed in the second unit and electrically connected to the high-voltage circuit board, wherein in a case in which the second unit is attached to the apparatus body, the first electrical contact portion and the second electrical contact portion come into contact with each other so that the high-voltage circuit board in the second unit and the first roller in the first unit are electrically connected with each other without passing through the second roller, and wherein in a case in which the second unit is drawn out from the apparatus body, the first electrical contact portion and the second electrical contact portion are separated from each other so that the high-voltage circuit board in the second unit and the first roller in the first unit are electrically disconnected from each other.

4. The image forming apparatus according to claim 3, wherein in the case in which the second unit is drawn out from the apparatus body, the first electrical contact portion and the second electrical contact portion are separated from each other so that an electrical connection between the high-voltage circuit board and the first roller is cut off.

5. The image forming apparatus according to claim 3, further comprising:

a positioning member disposed in the first unit and configured to position the second unit with respect to the first unit in a case in which the second unit is attached to the apparatus body, wherein the first electrical contact portion is attached to the positioning member and electrically connected to the first roller.

6. The image forming apparatus according to claim 5, wherein the second unit is configured to be attached to the apparatus body in a direction along an axial direction of the second roller.

7. The image forming apparatus according to claim 6, wherein the first electrical contact portion includes (i) a plate fixed to the positioning member and (ii) a contact pin that is movable with respect to the plate and is configured to be moved in the direction along the axial direction of the second roller by being pressed by the second electrical contact portion.

8. The image forming apparatus according to claim 1, further comprising:

a resistor disposed in the second unit and configured to be electrically connected to the high-voltage circuit board; and a fan disposed in the second unit and configured to cool the resistor.

9. The image forming apparatus according to claim 1, further comprising:

a power source disposed in the apparatus body and configured to feed electric power to the first roller via the high-voltage circuit board.

10. An image forming apparatus comprising:

an apparatus body having an image forming unit configured to form a toner image on an image bearing member;

a first unit including an intermediate transfer belt on which the toner image is transferred from the image bearing member and a first roller disposed in contact with an inner surface of the intermediate transfer belt to stretch the intermediate transfer belt;

a second unit including a second roller configured to form, with the first roller, a transfer nip portion in which the toner image is transferred from the intermediate transfer belt to a recording material, the second unit being drawable from the apparatus body;

a high-voltage circuit board disposed in the second unit and configured to apply a voltage to the first roller;

a resistor disposed at a separate position from the high-voltage circuit board in the second unit and configured to be electrically connected to the high-voltage circuit board by a wire; and a fan disposed in the second unit and configured to cool the resistor.

11. An image forming apparatus comprising:

an apparatus body having an image forming unit configured to form a toner image on an image bearing member;

a first unit including an intermediate transfer belt on which the toner image is transferred from the image bearing member and a first roller disposed in contact with an inner surface of the intermediate transfer belt to stretch the intermediate transfer belt;

a second unit including a second roller configured to form, with the first roller, a transfer nip portion in which the toner image is transferred from the intermediate transfer belt to a recording material, the second unit being drawable from the apparatus body; and a high-voltage circuit board disposed in the second unit and configured to apply a voltage to the first roller, wherein the first unit further comprises:

a bearing rotatably supporting the first roller, a holding member holding the bearing, a power feed member disposed in contact with a first end of the first roller in an axial direction of the first roller and configured to electrically connect the first roller and the high-voltage circuit board to each other, and a cover made of insulating material and configured to hold the power feed member, wherein the first roller and the bearing are restricted from moving in the axial direction in a state in which the cover is attached to the holding member, and wherein the first roller and the bearing are detachable from the holding member by being moved in the axial direction in a state in which the cover is detached from the holding member.

* * * * *